US007744086B2

(12) United States Patent
Echerer et al.

(10) Patent No.: US 7,744,086 B2
(45) Date of Patent: Jun. 29, 2010

(54) METHOD AND APPARATUS FOR TRANSPORTING FLAT PRODUCTS

(75) Inventors: Siegmund Echerer, Neukirchen (DE); Hubert Schalk, Thierhaupten (DE); Christian Winterholler, Friedberg (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 646 days.

(21) Appl. No.: 11/266,907

(22) Filed: Nov. 4, 2005

(65) Prior Publication Data

US 2006/0117592 A1 Jun. 8, 2006

(30) Foreign Application Priority Data

Nov. 5, 2004 (DE) ..... 10 2004 054 044

(51) Int. Cl.
*B65H 29/54* (2006.01)

(52) U.S. Cl. ..... 271/310; 271/69

(58) Field of Classification Search ..... 271/69, 271/70, 310

See application file for complete search history.

(56) References Cited

U.S. PATENT DOCUMENTS

| | | | | |
|---|---|---|---|---|
| 4,017,065 | A * | 4/1977 | Poehlein | 271/314 |
| 4,017,067 | A * | 4/1977 | Soures et al. | 271/314 |
| 4,058,306 | A * | 11/1977 | Fletcher | 271/307 |
| 4,060,235 | A * | 11/1977 | Weikel, Jr. | 271/310 |
| 4,244,565 | A | 1/1981 | Geier | |
| 6,059,283 | A | 5/2000 | Yoneda | |
| 6,138,565 | A * | 10/2000 | Koch et al. | 101/420 |
| 6,361,041 | B2 * | 3/2002 | Stephan | 271/195 |

FOREIGN PATENT DOCUMENTS

| | | |
|---|---|---|
| DE | 31 07 551 A1 | 9/1982 |
| DE | 31 51 285 C1 | 4/1983 |
| DE | 38 27 701 C2 | 3/1989 |
| DE | 102 19 540 B3 | 1/2004 |
| EP | 0 141 287 B2 | 10/1993 |
| FR | 2 549 025 | 1/1985 |

* cited by examiner

*Primary Examiner*—Patrick Mackey
*Assistant Examiner*—Michael C McCullough
(74) *Attorney, Agent, or Firm*—Crowell & Moring LLP

(57) ABSTRACT

During the transport of flat products, in particular folded products which are transferred at the end of a transport path to an assembly which forwards them, a great degree of freedom from faults can be attained by the fact that, in the case of lower transport speeds, the products are accelerated during the transfer by air which passes along them at a higher speed in the transport direction than the transport speed. In the case of higher transport speeds, the products are expediently braked during the transfer by reducing the pressure in the gap between one of their surfaces and an adjacent guide surface.

7 Claims, 2 Drawing Sheets

METHOD AND APPARATUS FOR TRANSPORTING FLAT PRODUCTS

This application claims the priority of German Patent Document No. 10 2004 054 044.6, filed Nov. 5, 2004, the disclosure of which is expressly incorporated by reference herein.

BACKGROUND AND SUMMARY OF THE INVENTION

According to a first concept of the invention, the invention relates to a method for transporting flat products, in particular folded products which are transferred at the end of a transport path to an assembly which forwards them and is preferably moved transversely with respect to the transport path.

A further concept of the invention relates to an apparatus which is suitable for carrying out this method, having a transport gap which is formed by conveying elements which are moved in the transport direction and lie opposite one another, it being possible to supply the products to the transport gap which is delimited on at least one side by at least one stationary guide element in the region of its end which is assigned to an assembly which forwards the products and is preferably moved transversely with respect thereto, the transport gap being assigned air nozzles which can act on the products coming out of the transport gap.

During the transport of folded products, etc., by means of a belt guidance means, there is the risk that the products are charged electrically on account of unavoidable friction. The consequence of this is that the movement of the products is impeded during the transfer to an assembly which is arranged after the belt guidance means, such as a paddle wheel, etc. This is true, in particular, at relatively low production speeds, such as occur, for example, during the starting-up operation or braking operation, where the kinetic energy of the products is not sufficiently great to overcome the tendency of the products to adhere, which is brought about on account of the electric charging. The invention is shown that, in such a case, the products can remain attached to stationary guide elements with their rear end region or to the associated paddle of the paddle wheel with their front end region. In both cases, the products do not pass entirely into the associated compartment of the paddle wheel, with the result that the rear ends can block the entrance to the next compartment, which leads to disruptions.

German Patent Document No. DE 102 19 540 B3 has disclosed an apparatus of the abovementioned type, in which blower nozzles are attached on both sides of the transport gap, which blower nozzles are directed towards the adjacent product surface and are intended to keep the latter away from stationary guide tongues. Although this counteracts the rear product ends getting caught on the stationary guide tongues, the risk of it being possible for the front end regions of the products to get caught on the associated paddle of the paddle wheel cannot be prevented with this known arrangement. It is not possible to use the known arrangement to accelerate the products in order to increase their kinetic energy to such an extent that an inclination to adhere is overcome. The same is true conversely for a braking operation.

In addition, the air jets which impact on the product surface approximately perpendicularly with respect to the latter cannot guide the products. It can therefore occur that the products become tilted, etc., which can likewise lead to disturbances.

Proceeding from this, it is the object of the present invention to improve a method and an apparatus in such a way that a high level of freedom from faults is attained.

In conjunction with the method according to the generic type, this object is achieved by the fact that, in the case of lower transport speeds, the products are accelerated during the transfer by air which passes along them at a higher speed in the transport direction than the transport speed.

The solution, in apparatus terms, of the object according to the invention consists in the fact that, in the apparatus of the generic type, the air nozzles have a jet direction which is substantially parallel to the transport plane and points in the transport direction, it being possible to apply compressed air to the air nozzles, at least in the case of lower transport speeds, in such a way that the air which emerges from them has a higher speed than the transport speed.

These measures lead to an air film which passes along the products at high speed and not only separates the products from an adjacent stationary guide element but accelerates them at the same time in the transport direction. The products are therefore not only guided reliably but are also given sufficient kinetic energy that, even in the case of an absent or weak air film, an inclination to adhere on account of electrostatic attraction is overcome. The front edges of the products therefore advantageously pass reliably as far as the base of the paddle wheel, as a result of which disturbances of the type mentioned in the introduction are avoided reliably.

Advantageous refinements and expedient developments of the superior measures are further specified. In the case of higher transport speeds, the products can thus be braked during the transfer by reducing the pressure in the gap between one of their surfaces and an adjacent guide surface. For this purpose, the air nozzles can be connected to a vacuum source, with the result that there is a drop in pressure. As a consequence of the drop in pressure, the products are attracted by suction and braked as a result. In this case, there is no need to fear that the products will get caught on account of electrostatic attraction, as the kinetic energy of the products is sufficiently high here to overcome electrostatic attraction forces.

A further expedient measure can consist in the fact that the air nozzles are assigned to a guide plate which extends over the width of the transport gap. This makes it possible to form an air film reliably over the entire width.

The guide plate can advantageously be provided with tongues which engage into grooves of an adjacent belt deflection roller. As a result, a transfer is attained which is free from disturbances.

A further, particularly expedient measure can consist in the fact that a plurality of nozzle rows which extend in the transport direction are provided over the width of the guide plate. The nozzle rows can be switched on and off individually, which makes simple adaptation to the respectively processed product format possible.

BRIEF DESCRIPTION OF THE DRAWINGS

Further advantageous refinements and expedient developments of the superior measures are specified and can be gathered in greater detail from the following exemplary description using the drawings.

DETAILED DESCRIPTION OF THE DRAWINGS

The main field of application of the invention is belt guidance means which are arranged at the outlet of folders and in each case have a paddle wheel arranged behind them, the compartments of which are moved in a circumferential direction which traverses the transport direction.

Figure 1:
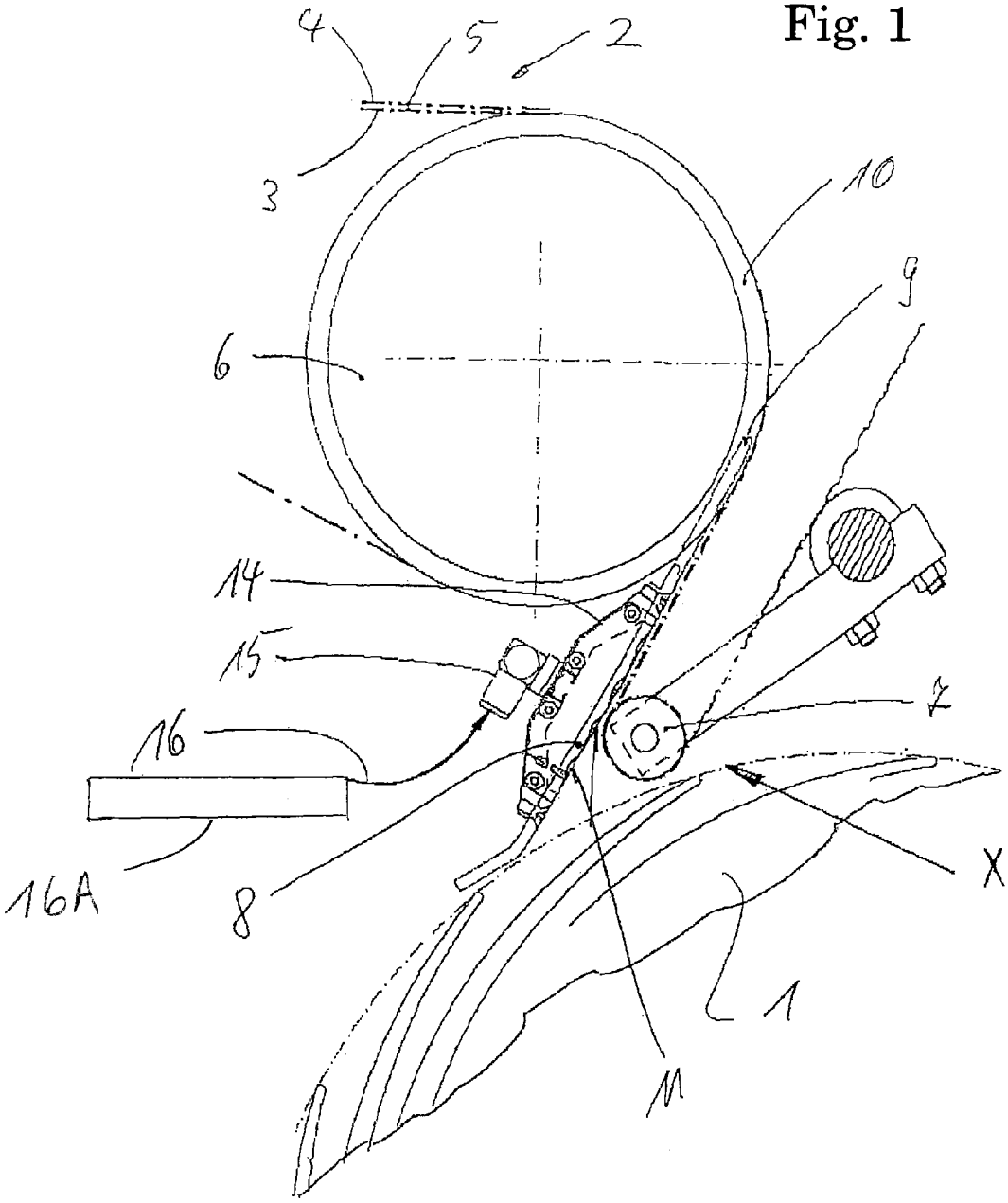
FIG. 1 shows a diagrammatic side view of a belt guidance means which ends above a paddle wheel.

FIG. 1 shows a paddle wheel 1 which is fed folded products which have been processed in a folder (not shown in greater detail), by means of a belt guidance means 2. The belt guidance means 2 comprises, in a manner known per se, lower belts 3 and upper belts 4 which delimit a transport gap 5 which can be loaded with the products. The lower belts 3 are deflected at a deflection roller 6 which has a comparatively large diameter and is arranged at a spacing above the paddle wheel 1. The upper belts 4 are guided past the deflection roller 6 and articulated at a deflection roller 7 which has a comparatively small diameter and is immediately adjacent to the circumference of the paddle wheel 1.

Lying opposite that region of the upper belts 4 which is guided past the deflection roller 6, a stationary guide plate 8 is arranged which preferably goes beyond the end of the upper belts 4, extends over the width of the belt guidance means 2 and by means of which the transport gap 5 is extended beyond the upper deflection roller 6. In order to ensure reliable entry of the products into the lower section of the transport gap 5 which is delimited by the guide plate 8 and that end region of the upper belts 4 which lies opposite the guide plate 8, the guide plate 8 is provided in the region of its rear edge with tongues 9, as can be seen best in FIG. 2, which tongues 9 stand away at the rear, are arranged at a spacing next to one another and engage into associated grooves 10 of the deflection roller 6, as can be seen from FIG. 1.

Figure 2:
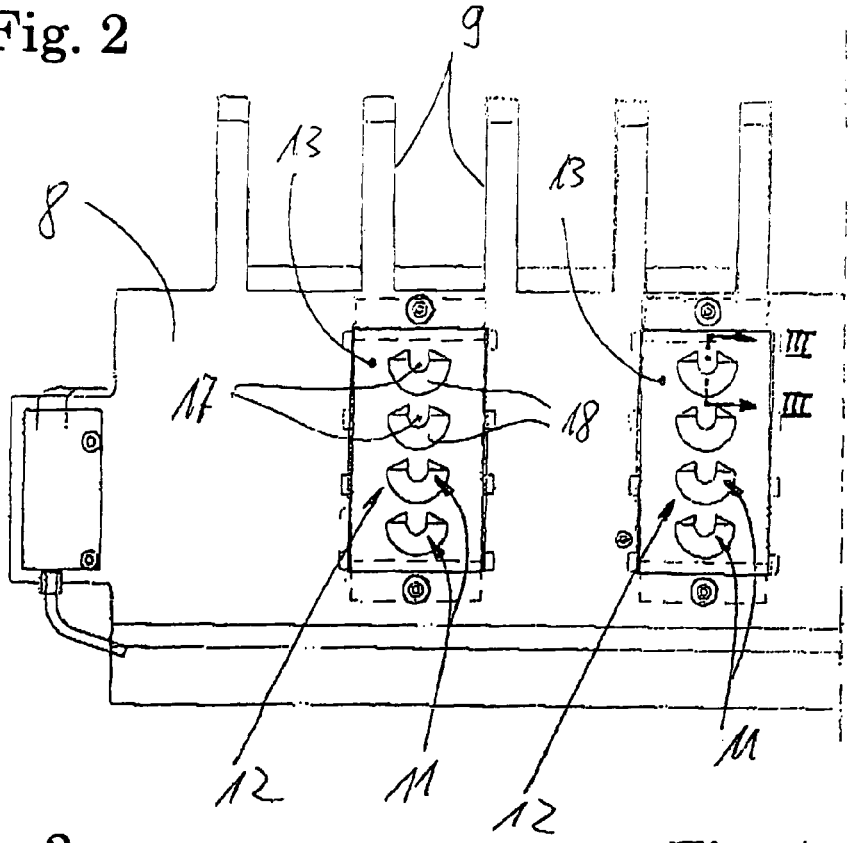
FIG. 2 shows a plan view of the guide plate from FIG. 1, as viewed in the direction X.

On its side which faces the transport gap 5, the guide plate 8 is provided with a plurality of air nozzles 11 which are distributed over its surface. As can be seen in FIG. 2, the air nozzles 11 are arranged in the form of a plurality of nozzle rows 12 which are distributed over the width of the guide plate 8 and extend in the transport direction. The nozzle rows 12 can expediently be activated or de-activated separately from one another, which makes simple adaptation to the respectively processed product format possible. The nozzle rows 12 are contained in each case in an associated plate 13 which is arranged flush with the corresponding surface of the guide plate 8 on the transport-gap side. The plates 13 which each contain a nozzle row 12 are configured in each case as the base of a spreader box 14 which can be seen in FIG. 1. Each spreader box 14 is provided with a connection fitting 15 for a supply line 16.

As can be seen in FIG. 2, the plates 13 are provided with tongues 17 which are U-shaped here and extend in the transport direction, and with recess-shaped depressions 18 which surround the tongues 17 respectively, for forming the nozzles 11. The tongues 17 and depressions 18 can be manufactured by a single punching operation, the tongues 17 being cut out and the depressions 18 then being pressed in. The gap-side surface of the tongues 17 is at the same level as the gap-side surface of the guide plate 8. As can be seen from FIG. 3, the depth of the depressions 18 is somewhat greater than the wall thickness of the plate 13 which contains them, so that a narrow passage gap 19 results along the edge of the respective tongue 17, through which passage gap 19 a flat air flow 20 which is directed in the transport direction can emerge, as is indicated by arrows in FIGS. 3 and 4.

At relatively low machine speeds, for example during the starting-up operation, the products which leave the belt guidance means 2 have comparatively little kinetic energy. In this case, compressed air is supplied to the spreader boxes 14 via the respectively associated supply line 16. For this purpose, the supply lines 16 are connected to a suitable compressed air source 16A, as can be seen in FIG. 1. The flat compressed air jets 20 which emerge in the process from the nozzles 11 form a thin air film here between the guide plate 8 and the products which are moving past the latter. Here, the pressure of the compressed air used is selected in such a way that the speed of the air jets 20 which emerge from the nozzles 11 is higher than the transport speed.

Figure 3:
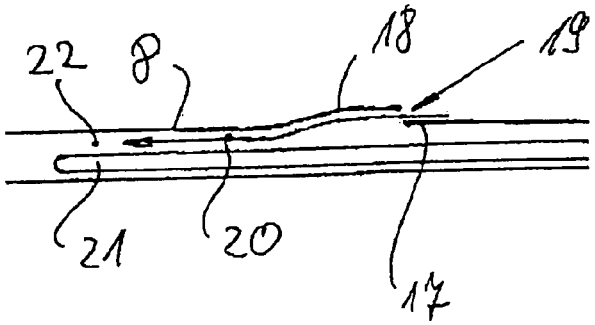
FIG. 3 shows a section along the line III/III in FIG. 2.
Figure 4:
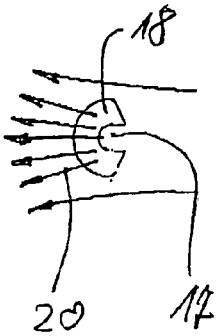
FIG. 4 shows a plan view of FIG. 3.

As is indicated in FIG. 4, the air which emerges from the nozzles 11 in the transport direction at a comparatively high speed moves adjacent air with it according to the ejector principle and passes along the facing surface of the products 21, as can be seen in FIG. 3, as a result of which the products 21 are accelerated in such a way that their kinetic energy is sufficient to overcome any possible adhesion forces which can result from an electrostatic charge. The products which are propelled thus into a respectively assigned compartment of the paddle wheel 1 therefore pass reliably as far as the base of the associated paddle-wheel compartment with their front edge.

At high machine speeds of, for example, 15 m/s and more, the products which leave the transport gap 5 have so much kinetic energy that they collide with the base of the associated paddle-wheel compartment with a comparatively severe impact and are compressed in the process, which can lead to disturbances as they expand again. In order to avoid this, the products are braked, for which purpose the apparatus according to the invention is likewise suitable.

For this purpose, the pressure is reduced in the gap 22 (shown in FIG. 3) between the guide plate 8 and the products 21 which are moving past the latter, with the result that the products 21 are sucked to the facing surface of the guide plate 8, which leads to braking. The abovementioned pressure reduction can be carried out by the application of vacuum to the spreader boxes 14 and accordingly to the air nozzles 11. For this purpose, the supply lines 16 of the relevant spreader boxes 14 are connected to a suitable vacuum source. The spreader boxes 14 and accordingly the nozzles 11 can accordingly be supplied in a manner which can be switched between the application of compressed air and the application of vacuum.

Figure 5:
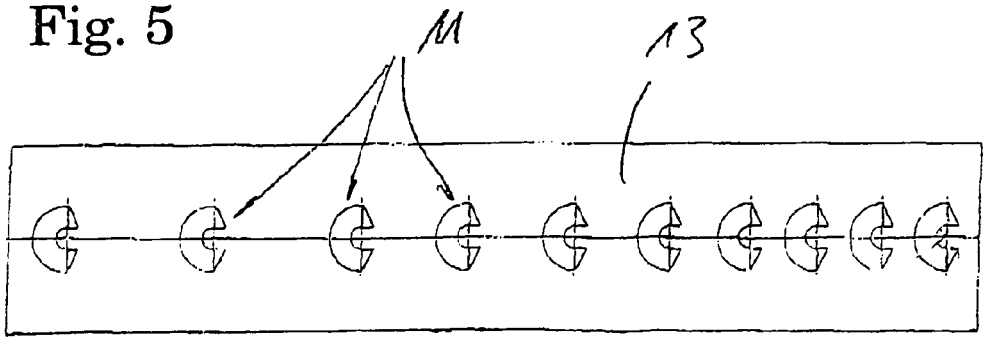
FIG. 5 shows an example of a nozzle row with different nozzle spacings.

In the example on which FIG. 2 is based, the spacing of the nozzles 11 which follow one another in the transport direction is uniform. However, it would also be conceivable to vary the nozzle spacing. FIG. 5 shows an example with a nozzle spacing which increases in the transport direction.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for transporting a flat product, comprising:

a transport gap which is formed by conveying elements which are moved in a transport direction and lie opposite one another, wherein the flat product is supplied to the transport gap which is delimited on at least one side by at least one stationary guide plate in a region of an end of the transport gap which is assigned to a paddle wheel which forwards the flat product and is moved transversely with respect thereto;

wherein the transport gap is assigned air nozzles which act on the flat product coming out of the transport gap, wherein the air nozzles have a jet direction which is substantially parallel to a transport plane and points in the transport direction, and wherein a compressed air source coupled to the air nozzles via a supply line supplies compressed air to the air nozzles and wherein compressed air from the air nozzles has a higher speed in the transport direction than a transport speed of the flat product such that the flat product is accelerated by the compressed air.

2. The apparatus according to claim 1, wherein the air nozzles are included in a surface of the at least one stationary guide plate which extends over a width of the transport gap.

3. The apparatus according to claim 2, wherein the at least one stationary guide plate is provided with a tongue which engages into a groove of a belt deflection roller.

4. The apparatus according to claim 2, wherein the air nozzles are arranged in a form of a plurality of nozzle rows which extend in the transport direction and which are distributed over a width of the at least one stationary guide plate.

5. The apparatus according to claim 4, wherein each of the plurality of nozzle rows is contained on a respective plate, wherein the plates are arranged flush with a transport gap-side surface of the at least one stationary guide plate, wherein the plates are configured as a base of a spreader box which is connected to the supply line, and wherein the plates are inserted into the at least one stationary guide plate.

6. The apparatus according to claim 5, wherein the plates have a plurality of cut-out tongues which point in the transport direction and a plurality of recess-shaped depressions which surround respective tongues and wherein the respective tongues and depressions form the air nozzles.

7. The apparatus according to claim 1, wherein a spacing of the air nozzles in the transport direction is unequal and increases.

* * * * *